US006682865B2

(12) United States Patent
Viturro et al.

(10) Patent No.: US 6,682,865 B2
(45) Date of Patent: Jan. 27, 2004

(54) HYBRID ELECTROPHOTOGRAPHIC APPARATUS FOR CUSTOM COLOR PRINTING

(75) Inventors: R. Enrique Viturro, Rochester, NY (US); John F. Knapp, Fairport, NY (US); Anthony M. Wallace, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/989,676

(22) Filed: Nov. 21, 2001

(65) Prior Publication Data

US 2003/0096186 A1 May 22, 2003

(51) Int. Cl.[7] ..... G03G 13/10

(52) U.S. Cl. ..... 430/45; 430/117; 430/120; 430/54; 399/237

(58) Field of Search ..... 430/45, 117, 54, 430/120; 399/237, 251, 290

(56) References Cited

U.S. PATENT DOCUMENTS

| | | | | |
|---|---|---|---|---|
| 3,729,419 A | | 4/1973 | Honjo et al. | 252/62.1 |
| 3,841,893 A | | 10/1974 | Honjo et al. | 117/37 LE |
| 3,968,044 A | | 7/1976 | Tamai et al. | 252/62.1 L |
| 4,286,039 A | | 8/1981 | Landa et al. | 430/119 |
| 4,476,210 A | | 10/1984 | Croucher et al. | 430/114 |
| 4,707,429 A | | 11/1987 | Trout | 430/115 |
| 4,762,764 A | | 8/1988 | Ng et al. | 430/115 |
| 4,794,651 A | | 12/1988 | Landa et al. | 430/110 |
| 4,833,503 A | | 5/1989 | Snelling | 355/259 |
| 5,351,113 A | | 9/1994 | Pietrowski et al. | 355/273 |
| 5,450,165 A | | 9/1995 | Henderson | 355/208 |
| 5,451,483 A | | 9/1995 | Fuller et al. | 430/114 |
| 5,557,393 A | | 9/1996 | Goodman et al. | 355/326 R |
| 5,695,904 A | * | 12/1997 | Larson et al. | 430/119 |
| 5,708,936 A | | 1/1998 | Wang et al. | 399/239 |
| 5,713,062 A | | 1/1998 | Goodman et al. | 399/49 |
| 5,722,017 A | | 2/1998 | Caruthers, Jr. et al. | 399/238 |
| 5,781,828 A | | 7/1998 | Caruthers, Jr. et al. | 399/57 |
| 5,897,239 A | | 4/1999 | Caruthers, Jr. et al. | 399/54 |
| 5,899,605 A | | 5/1999 | Caruthers, Jr. et al. | 399/223 |
| 5,916,718 A | * | 6/1999 | Kellie et al. | 430/45 |
| 5,923,356 A | | 7/1999 | Gibson et al. | 347/131 |
| 5,974,292 A | | 10/1999 | Domoto et al. | 399/249 |
| 6,002,893 A | | 12/1999 | Caruthers, Jr. et al. | 399/54 |
| 6,018,636 A | | 1/2000 | Caruthers | 399/57 |
| 6,049,683 A | | 4/2000 | Liu et al. | 399/237 |
| 6,052,195 A | | 4/2000 | Mestha et al. | 356/425 |
| 6,066,422 A | | 5/2000 | Blaszak et al. | 430/45 |
| 6,167,224 A | * | 12/2000 | Dalal | 430/45 |

FOREIGN PATENT DOCUMENTS

| | | | | |
|---|---|---|---|---|
| EP | 0725322 A | * | 8/1996 | G03G/15/10 |
| JP | 09080823 A | * | 3/1997 | |

OTHER PUBLICATIONS

Goodman, Nancy. "Custom Color Liquid Ink Development." Xerox Disclosure Journal, vol. 21, No. 2, p. 155. (1996).*

Goodman, Nancy. "Custom Color Liquid Ink Development (LID) Process." Xerox Disclosure Journal, vol. 21, No. 2, p. 157. (1996).*

Attorney Docket No. D/A0747Q, filed concurrently herewith, entitled "Hybird Electrophotographic Apparatus for Custom Color Printing," by Enrique Viturro et al. (09/989669).

* cited by examiner

*Primary Examiner*—Christopher Rodee
(74) *Attorney, Agent, or Firm*—Lloyd F. Bean, II

(57) ABSTRACT

A development system is provided that extends the functionality of liquid developer to produce custom colors and combines it with a powder development engine to enable custom color printing. This invention provides a apparatus and method, control scheme, hardware, and software, necessary for enabling custom color printing using an electrophotograpic hybrid technology.

5 Claims, 3 Drawing Sheets

HYBRID ELECTROPHOTOGRAPHIC APPARATUS FOR CUSTOM COLOR PRINTING

This invention relates generally to color imaging employed in electrography, particular to a method for automatically control mixed primary colorants to match a customer-selected color which is integrated with a color applicator, such as a xerographic printer using liquid and dry xerographic toners.

BACKGROUND OF THE INVENTION

Cross reference is made to the following application filed concurrently herewith: U.S. patent application Ser. No. 09/989,669, now U.S. Pat. No. 6,526,244, entitled "Hybrid Electrophotographic Apparatus For Custom Color Printing," by Enrique Viturro, John F. Knapp, and Anthony Walsh.

One method of printing in different colors is to uniformly charge a charge retentive surface and then expose the surface to information to be reproduced in one color. This information is rendered visible using marking particles followed by the recharging of the charge retentive surface prior to a second exposure and development. This recharge/expose/and develop (REaD) process may be repeated to subsequently develop images of different colors in superimposed registration on the surface before the full color image is subsequently transferred to a support substrate. The different colors may be developed on the photoreceptor in an image on image development process, or a highlight color image development process (image next-to image). Each different image may be formed by using a single exposure device, e.g. ROS, where each subsequent color image is formed in a subsequent pass of the photoreceptor (multiple pass). Alternatively, each different color image may be formed by multiple exposure devices corresponding to each different color image, during a single revolution of the photoreceptor (single pass).

Electrostatographic printing systems typically develop an electrostatic latent image using solid toner particles either in powder form or suspended in a liquid carrier. In liquid developing systems, the liquid developer typically has about two percent by weight toner material distributed in the liquid carrier. An electrostatic latent image is developed by applying the liquid developer to the photoconductive member, whereby the toner particles are selectively attracted to the surface of the photoconductive member in accordance with an electrostatic latent image.

Customer selectable colors are typically utilized to provide instant identification and authenticity to a document. As such, the customer is usually highly concerned that the color meets particular color specifications. For example, the red color associated with Xerox' digital stylized "X" is a customer selectable color having a particular shade, hue and color value. Likewise, the particular shade of orange associated with Syracuse University is a good example of a customer selectable color. A more specialized example of customer selectable color output can be found in the field of "custom color", which specifically refers to registered proprietary colors, such as used, for example, in corporate logos, authorized letterhead and official seals. The yellow associated with Kodak brand products, and the brown associated with Hershey brand products are good examples of custom colors which are required to meet exacting color standards in a highlight color or spot color printing application.

The various colors typically utilized for standard highlighting processes generally do not precisely match customer selectable colors. Moreover, customer selectable colors typically cannot be accurately generated via halftone process color methods because the production of solid image areas of a particular color using halftone image processing techniques typically yields non-uniformity of the color in the image area.

Further, lines and text produced by halftone process color are very sensitive to misregistration of the multiple color images such that blurring, color variances, and other image quality defects may result. As a result of the deficiencies noted above, customer selectable color production in electrostatographic printing systems is typically carried out by providing a singular premixed developing material composition made up of a mixture of multiple color toner particles blended in preselected concentrations for producing the desired customer selectable color output. This method of mixing multiple color toners to produce a particular color developing material is analogous to processes used to produce customer selectable color paints and inks. In offset printing, for example, a customer selectable color output image is produced by printing a solid image pattern with a premixed customer selectable color printing ink as opposed to printing a plurality of halftone image patterns with various primary colors or compliments thereof.

This concept has generally been extended to electrostatographic printing technology, as disclosed, for example, in commonly assigned U.S. Pat. No. 5,557,393, wherein an electrostatic latent image is developed by a dry powder developing material comprising two or more compatible toner compositions which have been mixed together to produce a customer selectable color output. Customer selectable color printing materials including paints, printing inks and developing materials can be manufactured by determining precise amounts of constituent basic color components making up a given customer selectable color material, providing precisely measured amounts of each constituent basic color component, and thoroughly mixing these color components.

This process is commonly facilitated by reference to a color guide or swatch book containing hundreds or even thousands of swatches illustrating different colors, wherein each color swatch is associated with a specific formulation of colorants. Probably the most popular of these color guides is published by PANTONE®, Inc. of Moonachie, N.J. The PANTONE® Color Formula Guide expresses colors using a certified matching system and provides the precise formulation necessary to produce a specific customer selectable color by physically intermixing predetermined concentrations of up to four colors from a set of up to 18 principal or basic colors. There are many colors available using the PANTONE® system or other color formula guides of this nature that cannot be produced via typical halftone process color methods or even from mixing selected amounts of cyan, magenta, yellow and/or black inks or developer materials.

In the typical operational environment, an electrostatographic printing system may be used to print various customer selectable color documents. To that end, replaceable containers of premixed customer selectable color developing materials corresponding to each customer selectable color are provided for each print job.

Replacement of the premixed customer selectable color developer materials or substitution of another premixed color between different print jobs necessitates operator intervention which typically requires manual labor and machine downtime, among other undesirable requirements. In addition, since each customer selectable color is typically manufactured at an off-site location, supplies of each customer selectable color printing ink must be separately stored for each customer selectable color print job.

Conventional liquid printing systems, such as liquid immersion development (LID) systems, can generate custom colors by combining two or more primary color toners before depositing the toners and then using the mixed toner to develop an electrostatic latent image. However, due to the differences in physical and chemical properties of the toners of different colors and other factors, a sophisticated feedback scheme must be used to obtain accurate color reproduction and color stability. For example, the differential mobility of the mixed toners often results in different consumption rates of different toner during development, requiring complex color control techniques to maintain a desired composition, e.g. color, of the toner and the color and density of the toner image created.

The on-demand custom color capability of electrostatographic printing systems may vary significantly due to numerous conditions affecting image development, among various factors, including but certainly not limited to the methods and apparatus used to mix the primary colors to achieve the desired custom color and the process controls implemented on the color mixing and development subsystems to maintain the color accuracy and stability. In general, a number of primary color developers are mixed in a reservoir with certain proportions according to the customer selection and the consumption rate of the primary colors, and then the developer mixture is applied to the latent image for development. Exemplary patents which may describe certain general aspects for achieving customer selectable colors, as well as specific apparatus therefor, may be U.S. Pat. No. 5,781,828 to Caruthers et al., U.S. Pat. No. 6,052,195, U.S. Pat. No. 6,049,683 as well as other patents cited therein.

SUMMARY OF THE INVENTION

There is provided a method for creating a color image representing a document in a printing machine comprising: recording a first latent image on a charge retentive surface moving along an endless path; developing said latent image with a developer unit having developer material comprising dry marking particles of a first colored; recording a second latent image on a charge retentive surface moving along an endless path; developing said second latent image with a developer unit having developer material comprising a solution liquid carrier and marking particles of a second colored.

There is also provided an apparatus for developing an image on an imaging surface, comprising: a first developer unit having dry marking particles therein for developing a first portion of the image; and a second developer unit having a solution of marking particles and liquid carrier therein for developing a second portion of the image.

DETAILED DESCRIPTION OF THE INVENTION

Figure 1:
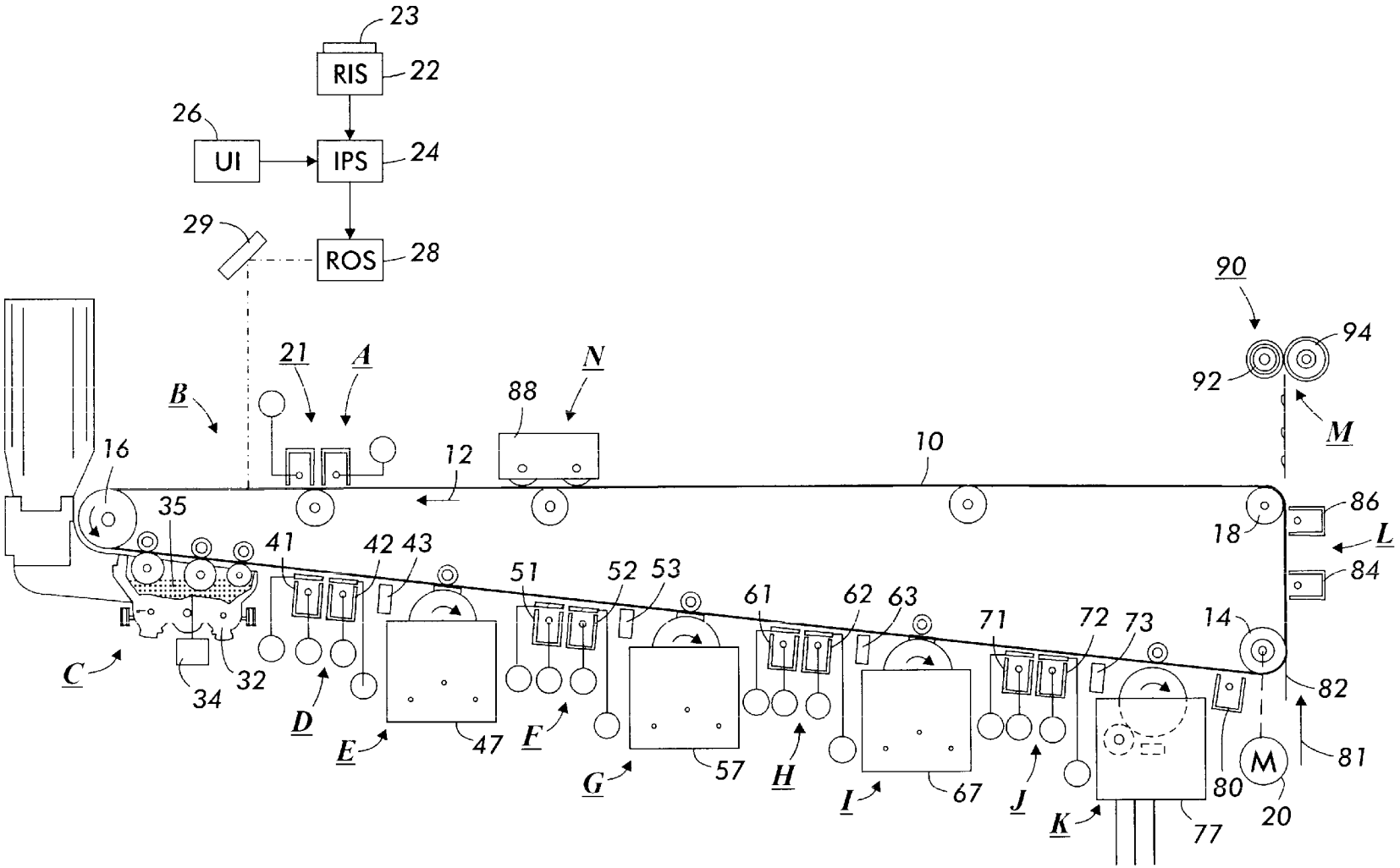
FIG. 1 is a schematic illustration of an example single pass imaging apparatus.

Turning now to FIG. 1, the electrophotographic printing machine uses a charge retentive surface in the form of a photoreceptor belt 10. The photoreceptor belt is supported by rollers 14, 16 and 18. Motor 20 operates the movement of roller 14, which in turn causes the movement of the photoreceptor in the direction indicated by arrow 12, for advancing the photoreceptor sequentially through the various xerographic stations.

With continued reference to FIG. 1, a portion of belt 10 passes through charging station A where a corona generating device, indicated generally by the reference numeral 20, charges the photoconductive surface of belt 10 to a relatively high, substantially uniform potential. For purposes of example, the photoreceptor is negatively charged, however it is understood that the present invention could be useful with a positively charged photoreceptor, by correspondingly varying the charge levels and polarities of the toners, recharge devices, and other relevant regions or devices involved in the image on image color image formation process, as will be hereinafter described.

Next, the charged portion of the photoconductive surface is advanced through an imaging and exposure station B. A document 23, with a multi-color image and/or text original, is positioned on a raster input scanner (RIS), indicated generally by the reference numeral 22. One common type of RIS contains document illumination lamps, optics, a mechanical scanning drive and a charged coupled device. The RIS captures the entire image from original document 23 and converts it to a series of raster scan lines and moreover measures a set of primary color densities, i.e. red, green and blue densities at each point of the original document. This information is transmitted as electrical signals to an image processing system (IPS), indicated generally by the reference numeral 24. IPS 24 converts the set of red, green and blue density signals to a set of colorant signals. Alternatively, multi-color image and/or text original can be externally computer generated and sent to IPS to be printed. which may include a portion image.

The IPS contains control electronics which prepare and manage the image data flow to a raster output scanning device (ROS), indicated by numeral 28. A user interface (UI) indicated by 26 is in communication with IPS 24. UI 26 enables an operator to control the various operator adjustable functions such as selecting portion document to be printed with a custom color. The operator actuates the appropriate keys of UI 26 to adjust the parameters of the copy. UI 26 may be a touch screen or any other suitable control panel providing an operator interface with the system. The output signal from UI 26 is transmitted to the IPS 24. The IPS then transmits signals corresponding to the desired image to ROS 28, which creates the output copy image. ROS 28 includes a laser with rotating polygon mirror blocks. The ROS illuminates, via mirror 29, the charged portion of a photoconductive belt 10. The ROS will expose the photoconductive belt to record single to multiple images which correspond to the signals transmitted from IPS 24.

The photoreceptor, which is initially charged to a voltage $V_0$, undergoes dark decay to a level $V_{ddp}$ equal to about −500 volts. When exposed at the exposure station B the image areas are discharged to $V_{DAD}$ equal to about −50 volts. Thus after exposure, the photoreceptor contains a monopolar voltage profile of high and low voltages, the former corresponding to charged areas and the latter corresponding to discharged or image areas.

A first development station C, indicated generally by the reference numeral 32, advances development material 35 into contact with the electrostatic latent image. The development housing 32 contains black toner. Appropriate developer biasing is accomplished via power supply 34. Electrical biasing is such as to effect discharged area development (DAD) of the lower (less negative) of the two voltage levels on the photoreceptor with the development material 35. This development system may be either an interactive or non-interactive system.

At recharging station D, a pair of corona recharge devices 41 and 42 are employed for adjusting the voltage level of both the toned and untoned areas on the photoreceptor surface to a substantially uniform level. A power supply coupled to each of the electrodes of corona recharge devices 41 and 42 and to any grid or other voltage control surface associated therewith, serves as a voltage source to the devices. The recharging devices 41 and 42 serve to substantially eliminate any voltage difference between toned areas and bare untoned areas, as well as to reduce the level of residual charge remaining on the previously toned areas, so that subsequent development of different color toner images is effected across a uniform development field. The first corona recharge device 41 overcharges the photoreceptor surface 10 containing previously toned and untoned areas, to a level higher than the voltage level ultimately required for $V_{ddp}$, for example to −700 volts. The predominant corona charge delivered from corona recharge device 41 is negative. The second corona recharge device 42 reduces the photoreceptor surface 10 voltage to the desired $V_{ddp}$, −500 volts. Hence, the predominant corona charge delivered from the second corona recharge device 42 is positive. Thus, a voltage split of 200 volts is applied to the photoreceptor surface. The voltage split (Vsplit) is defined as the difference in photoreceptor surface potential after being recharged by the first corona recharge device and the second corona recharge device, e.g. $V_{split}$=−700 volts (−500 volts)=−200 volts. The surface 10 potential after having passed each of the two corona recharge devices, as well as the amount of voltage split of the photoreceptor, are preselected to otherwise prevent the electrical charge associated with the developed image from substantially reversing in polarity, so that the occurrence of under color splatter (UCS) is avoided. Further, the corona recharge device types and the voltage split are selected to ensure that the charge at the top of the toner layer is substantially neutralized rather than driven to the reverse polarity (e.g. from negative to become substantially positive).

The recharge devices have been described generally as corona generating devices, with reference to FIG. 1. However, it is understood that the recharge devices for use in the present invention could be in the form of, for example, a corotron, scorotron, dicorotron, pin scorotron, or other corona charging devices known in the art. In the present example having a negatively charged photoreceptor, the negatively charged toner is recharged by a first corona recharge device of which the predominant corona charge delivered is negative. Thus, either a negative DC corona generating device, or an AC corona generating device biased to deliver negative current would be appropriate for such purpose. The second corona recharge device is required to deliver a predominantly positive charge to accomplish the objectives of the present invention, and therefore a positive DC or an AC corona generating device would be appropriate.

A second exposure or imaging device 43 which may comprise a laser based output structure is utilized for selectively discharging the photoreceptor on toned areas and/or bare areas to approximately −50 volts, pursuant to the image to be developed with the second color developer. After this point, the photoreceptor contains toned and untoned areas at relatively high voltage levels (e.g. −500 volts) and toned and untoned areas at relatively low voltage levels (e.g. −50 volts). These low voltage areas represent image areas, which are to be developed using discharged area development. To this end, a negatively charged developer material 45 comprising, for example, yellow color toner is employed. The toner is contained in a developer housing structure 47 disposed at a second developer station E and is presented to the latent images on the photoreceptor by a non-interactive developer. A power supply (not shown) serves to electrically bias the developer structure to a level effective to develop the DAD image areas with the negatively charged yellow toner particles 45.

At a second recharging station F, a pair of corona recharge devices 51 and 52 are employed for adjusting the voltage level of both the toned and untoned areas on the photoreceptor to a substantially uniform level. A power supply coupled to each of the electrodes of corona recharge devices 51 and 52 and to any grid or other voltage control surface associated therewith, serves as a voltage source to the devices. The recharging, imaging and developing process is similar to that of stations D and E and will not be described in detail. This image is developed using a third color toner 55 contained in a non-interactive developer housing 57 disposed at a third developer station G. An example of a suitable third color toner is magenta. Suitable electrical biasing of the housing 57 is provided by a power supply, not shown.

At a third recharging station H, a pair of corona recharge devices 61 and 62 are employed for adjusting the voltage level of both the toned and untoned areas on the photoreceptor to a substantially uniform level. A power supply coupled to each of the electrodes of corona recharge devices 61 and 62 and to any grid or other voltage control surface associated therewith, serves as a voltage source to the devices. The recharging and developing processes are again similar to those described for stations D and E and will not be described in detail.

A fourth latent image is created using an imaging or exposure device 63. A fourth DAD image is formed on both bare areas and previously toned areas of the photoreceptor that are to be developed with the fourth color image. This image is developed, for example, using a cyan color toner 65 contained in developer housing 67 at a fourth developer station 1. Suitable electrical biasing of the housing 67 is provided by a power supply, not shown.

The present invention adds a fourth recharging station J, a pair of corona recharge devices 71 and 72 are employed for adjusting the voltage level of both the toned and untoned areas on the photoreceptor to a substantially uniform level. A power supply coupled to each of the electrodes of corona recharge devices 71 and 72 and to any grid or other voltage control surface associated therewith, serves as a voltage source to the devices. Again the recharging, imaging and developing steps are similar to that of stations D and E.

A fifth latent image is created using a ROS device 73. A fifth DAD image is formed on the photoreceptor that are to be developed using a custom color toner. This image is developed contained in developer housing 77 at a fifth developer station K. Suitable electrical biasing of the housing 77 is provided by a power supply, not shown.

The developer housing structures 47, 57, and 67 are preferably of the type known in the art which do not interact, or are only marginally interactive with previously developed images. For example, a DC jumping development system, a powder cloud development system, and a sparse, noncontacting magnetic brush development systems are each suitable for use in an image on image color development system. A non-interactive, scavengeless development housing having minimal interactive effects between previously deposited toner and subsequently presented toner is described in U.S. Pat. No. 4,833,503, the relevant portions of which are hereby incorporated by reference herein.

Toner composition in developer housing structures 47, 57, and 67 may comprise any suitable resins, with or without other internal or external additives. As resin materials, toner compositions of the present invention may utilize any of the numerous suitable resins such as thermoplastic resins known in the art to be useful in producing toners and developers. Suitable resins that may be utilized in the present invention include but are not limited to olefin polymers such as polyethylene, polypropylene and the like; polymers derived from dienes such as polybutadiene, polyisobutylene, polychloroprene and the like; vinyl and vinylidene polymers such as polystyrene, styrene butyl methacrylate copolymers, styrene butylacrylate copolymers, styreneacrylonitrile copolymers, acrylonitrilebutadiene styrene terpolymers, polymethylmethacrylate, polyacrylate, polyvinyl alcohol, polyvinyl chloride, polyvinyl carbazole, polyvinyl ethers, polyvinyl ketones and the like; fluorocarbon polymers such as polytetrafluoroethylene, polyvinylidene fluoride and the like; heterochain thermoplastics such as polyamides, polyesters, polyurethanes, polypeptides, casein, polyglycols, polysulfides, polycarbonates and the like; and cellulosic copolymers such as regenerated cellulone, cellulose acetate, cellulose nitrate and the like; and mixtures thereof. Of the vinyl polymers, resins containing a relatively high percentage of styrene are preferred, such as homopolymers of styrene or styrene homologs of copolymers of styrene. One preferred resin used in the present invention is a copolymer resin of styrene and n-butylmethacrylate. Another preferred resin used in the present invention is a styrene butadiene copolymer resin with a styrene content of from about 70% to about 95% by weight, such as PLIOTONE® available from Goodyear Chemical. The resins are generally present in the toners of the present invention in an amount of from about 40% to about 98% by weight, and more preferably from about 70% to about 98% by weight; although they may be present in greater or lesser amounts, provided that the objectives of the present invention are achieved.

In order to condition the toner for effective transfer to a substrate, a negative pre-transfer corotron member 80 delivers negative corona to ensure that all toner particles are of the required negative polarity to ensure proper subsequent transfer. Another manner of ensuring the proper charge associated with the toner image to be transferred is described in U.S. Pat. No. 5,351,113, the relevant portions of which are hereby incorporated by reference herein.

Subsequent to image development a sheet of support material 82 is moved into contact with the toner images at transfer station L. The sheet of support material is advanced to transfer station L by conventional sheet feeding apparatus, not shown. Preferably, the sheet feeding apparatus includes a feed roll contacting the uppermost sheet of a stack of copy sheets. The feed rolls rotate so as to advance the uppermost sheet from a stack into a chute which directs the advancing sheet of support material into contact with the photoconductive surface of belt 10 in a timed sequence so that the toner powder image developed thereon contacts the advancing sheet of support material at transfer station L.

Transfer station L includes a transfer corona device 84 which sprays positive ions onto the backside of sheet 82. This attracts the negatively charged toner powder images from the belt 10 to sheet 82. A detack corona device 86 is provided for facilitating stripping of the sheets from the belt 10.

After transfer, the sheet continues to move, in the direction of arrow 81, onto a conveyor (not shown) which advances the sheet to fusing station M. Fusing station M includes a fuser assembly, indicated generally by the reference numeral 90, which permanently affixes the transferred powder image to sheet 82. Preferably, fuser assembly 90 comprises a heated fuser roller 92 and a backup or pressure roller 94. Sheet 82 passes between fuser roller 92 and backup roller 94 with the toner powder image contacting fuser roller 92. In this manner, the toner powder images are permanently affixed to sheet 82 after it is allowed to cool. After fusing, a chute, not shown, guides the advancing sheets 82 to a catch tray, not shown, for subsequent removal from the printing machine by the operator.

After the sheet of support material is separated from photoconductive surface of belt 10, the residual toner particles carried by the non-image areas on the photoconductive surface are removed therefrom. These particles may be removed at cleaning station N using a cleaning brush structure contained in a housing 88.

The various machine functions described hereinabove are generally managed and regulated by a controller preferably in the form of a programmable microprocessor (not shown). The microprocessor controller provides electrical command signals for operating all of the machine subsystems and printing operations described herein, imaging onto the photoreceptor, paper delivery, xerographic processing functions associated with developing and transferring the developed image onto the paper, and various functions associated with copy sheet transport and subsequent finishing processes.

The various machine functions described above are generally managed and regulated by a controller which provides electrical command signals for controlling the operations described above.

Figure 2:
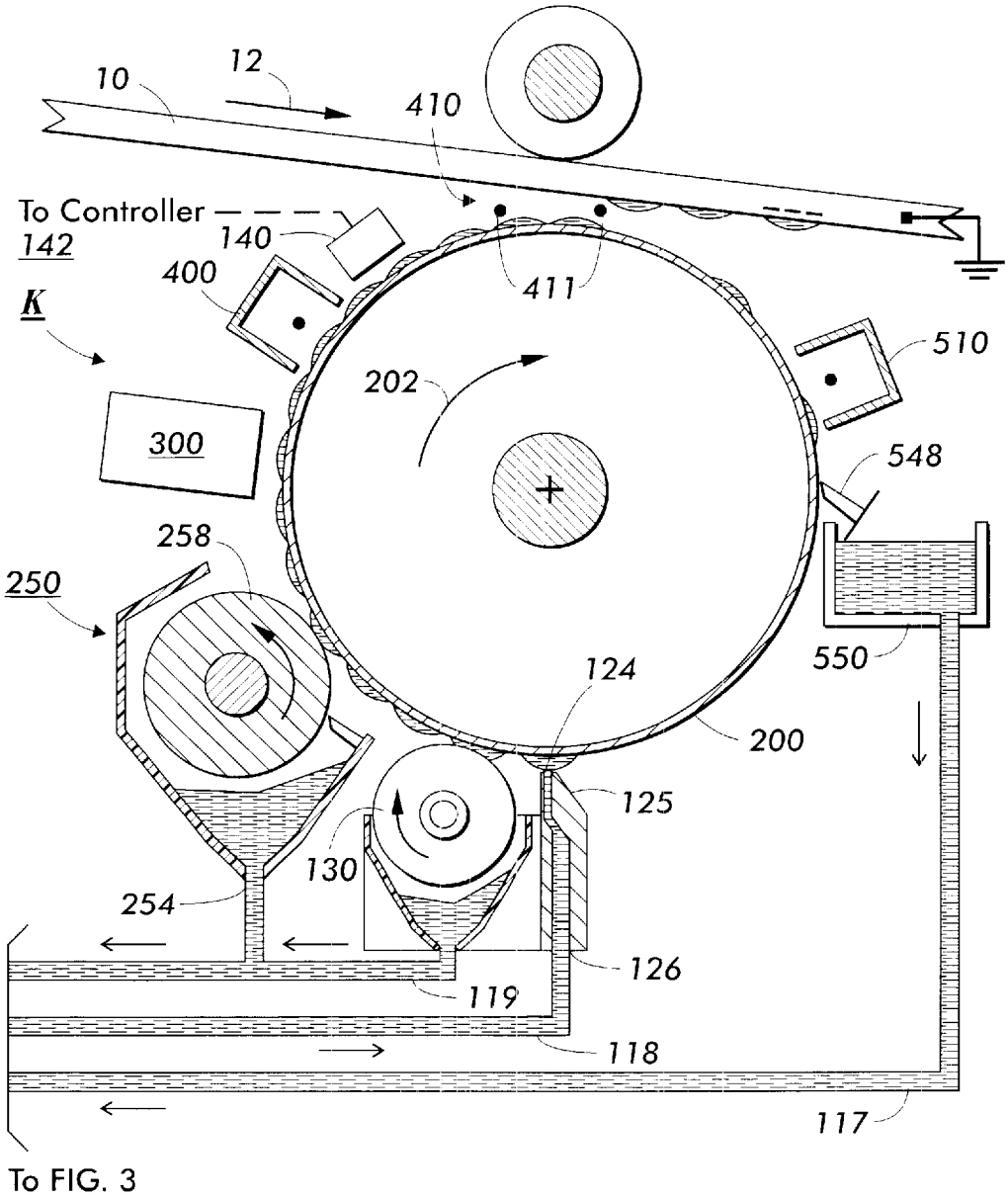
FIGS. 2 and 3 is a schematic, elevational view of an exemplary liquid developing material applicator and an exemplary liquid developing material development system incorporating a developing material color mixing system in accordance with the present invention.

Focusing on the liquid immersion development process before describing the color mixing and control system of the present invention, in the exemplary developing apparatus of the FIG. 2 liquid developing material is transported from an supply reservoir 150 to the donor roll or donor belt 200 via a liquid developing material applicator 125. Supply reservoir 150 acts as a holding receptacle for providing an operative solution of liquid developing material comprised of liquid carrier, a charge director compound, and toner material, which, in the case of the customer selectable color application of the present invention, includes a blend of different colored marking particles.

In accordance with the present invention, a plurality of replaceable supply dispensers 111A–111Z, each containing a concentrated supply of marking particles and carrier liquid corresponding to a basic color component in a color matching system, are provided in association with the operational supply reservoir 150 and coupled thereto for replenishing the liquid developing material therein, as will be described.

The exemplary developing material applicator 125 includes a housing 122, having an elongated aperture 124 extending along a longitudinal axis thereof so as to be oriented substantially transverse to the surface of donor roll 200, along the direction of travel thereof (as indicated by arrow 202), as shown, for example, by U.S. Pat. No. 5,708,936. The aperture 124 is coupled to an inlet port 126 which is further coupled to reservoir 150 via transport conduit 118. Transport conduit 118 operates in conjunction with aperture 124 to provide a path of travel for liquid developing material being transported from reservoir 150 and also defines a developing material application region in which the liquid developing material can freely flow in order to contact the surface of the donor roll 200. Thus, liquid developing material is pumped or otherwise transported from the supply reservoir 150 to the applicator 125 through at least one inlet port 126, such that the liquid developing material flows out of the elongated aperture 124 and into contact with the surface of donor roll 200. Such an overflow channel would be connected to an outlet channel 128 for removal of excess or extraneous liquid developing material, for flushing and cleaning with carrier fluid the developing material applicator 125, and, preferably, for directing this excess material back to reservoir 150 or to a waste sump 120 whereat the liquid developing material can preferably be collected and the components thereof can be recycled for subsequent use. The flushing and cleaning with carrier fluid enables automatic switching of custom colors between printing jobs. Slightly downstream of and adjacent to the developing material applicator 125, in the direction of movement of the donor roll surface 200, is an electrically biased metering roll 130, the peripheral surface thereof being situated in close proximity to the surface of the donor roll 200, as shown, for example, by U.S. Pat. No. 5,974,292, among various other patents. The metering roller 130 rotates in a direction opposite the movement of the surface of donor roll 200 so as to apply a substantial shear force and electrical bias to the thin layer of liquid developing material present in the area of the nip between the metering roller 130 and the donor roll 200, for minimizing the thickness of the liquid developing material on the surface thereof. These forces remove a predetermined amount of excess liquid developing material from the surface of the donor roll. The excess developing material eventually falls away from the rotating metering roll for collection in the reservoir 150 or a waste sump (not shown) via conduit 119.

Condition system 250 compress the liquid toner layer and remove some of the liquid carrier therefrom, as shown, for example, by U.S. Pat. No. 4,286,039, among various other patents. Condition system 250 comprising a roller, similar to roller 258 which may include a porous body and a perforated skin covering. The roller 258 is typically biased to a potential having a polarity which inhibits the departure of toner particles from the liquid toner layer on the donor roll while compacting the toner particles onto the surface of the donor roll 200. In this exemplary image conditioning system, a vacuum source (not shown) is also provided and coupled to the interior of the roller for creating an airflow through the porous roller body to draw liquid from the surface of the donor roll, thereby increasing the percentage of toner solids on donor roll 200. In operation, roller 258 rotates with the donor roll 250 such that the porous body of roller 258 absorbs excess liquid from the surface liquid toner layer through the pores and perforations of the roller skin covering. The vacuum source, typically located along one end of a central cavity, draws liquid through the roller skin to a central cavity for depositing the liquid in a receptacle or some other location which permits either disposal or recirculation of the liquid carrier. The porous roller 258 is thus continuously discharged of excess liquid to provide continuous removal of liquid from donor roll 200. Preferably after the liquid toner layer is condition, the liquid toner layer has a percentage of toner solids between 50 and 80 percent. The discharged of excess liquid carrier is removed from condition system 250 through outlet port 254 which couples to reservoir 150 or a waste sump (not shown) via transport conduit 119.

Next the layer of toner is brought under a heat and air convection device 300 where the last remains of liquid are evaporated to produce a dry toner layer. These process requires air temperature of about 30–45 C. Dry condition system 300 contains a carrier fluid recovery device that condenses the carrier fluid and a port and conduit to recycle the carrier fluid to the carrier fluid reservoir for further use.

Next the layer of toner is brought under corona charging device 400, where the toner is charged to an average Q/M ratio of from −30 to −50 microCoulombs/gram. Corona device 400 may be in the form of an AC or DC charging device (e.g. scorotron). As donor 200 is rotated further in the direction indicated by arrow, the now charged toner layer is moved into development zone 410, defined by the gap between donor 200 and the surface of the photoreceptor belt 10. The toner layer on the donor roll is then disturbed by electric fields from a wire or set of wires 411so as to produce an agitated cloud of toner particles. The cloud is also sustained by the AC voltage applied to the wires in the form of a square wave. Typical signal magnitudes are 700–900 Vpp at frequencies of 3–10 kHz. Toner from the cloud is then developed onto the nearby photoreceptor by fields created by a latent image. It should be noted that other forms of AC or DC jumping development system, a powder cloud development system, or fluidized bed development could be employed.

Next, the charge on the remaining toner is neutralized by charging device 510. Cleaning device 550 cleans donor roll 200 by using a cleaning blade or an electrostatic brush or a combination of both and spraying liquid developer fluid onto donor roll 200. Cleaning device 350 has a dispersing device that facilitates the dispersion of the toner in the carrier fluid. The excess developing material eventually falls away from the rotating metering roll for collection in the reservoir 150 or a waste sump (not shown) via transport conduit 117.

The application of developing material to the donor roll surface clearly depletes the overall amount of the operative solution of developing material in supply reservoir 150. Therefore, reservoir 150 is continuously replenished, as necessary, by the addition of developing material or selective components thereof, for example in the case of liquid developing materials, by the addition of liquid carrier, marking particles, and/or charge director into the supply reservoir 150. Since the total amount of any one component making up the developing material utilized to develop the image may vary as a function of the area of the developed image areas and the background portions of the latent image on the photoconductive surface, the specific amount of each of each component of the liquid developing material which must be added to the supply reservoir 150 varies with each development cycle.

For example, a print job having a developed image having a large proportion of printed image area will cause a greater depletion of marking particles and/or charge director from a developing material reservoir as compared to a print job having a developed image with a small amount of printed image area. Thus, it is known in the art that, while the rate of replenishment of the liquid carrier component of the liquid developing material may be controlled by simply monitoring the level of liquid developer in the supply reservoir 150, the rate of replenishment of the marking particles, and/or the charge director components of the liquid developing material in reservoir 150 must be controlled in a more sophisticated manner to maintain a the correct concentration for proper functionality of the marking particles and the charge director in the operative solution stored in the supply reservoir 150 (although that concentration may vary with time due to changes in operational parameters).

Systems have been disclosed in the patent literature and otherwise for systematically replenishing individual components making up the liquid developing material (liquid carrier, marking particles and/or charge director) as they are depleted from the reservoir 150 during the development process. See, for example, commonly assigned U.S. Pat. No. 5,923,356 and the references cited therein. The present invention, however, contemplates a liquid developing material replenishing system capable of systematically replenishing individual color components making up a customer selectable color liquid developing material composition. As such, the replenishment system of the present invention includes a plurality of differently colored developing material supply dispensers 111, 111B, 111C, . . . 111Z, each coupled to the operative supply reservoir via a respective associated valve member 116A, 116B 116C . . . 116Z, or other appropriate liquid flow control device. Preferably, each supply dispenser contains a developing material concentrate of a known basic or primary color such as Cyan, Magenta, Yellow and Black. In one specific embodiment, the replenishment system includes eighteen supply dispensers, wherein each supply container provides a different basic color liquid developing material corresponding to the eighteen basic or constituent colors of the PANTONE® Color Matching System used for custom color printing and process color printing.

This embodiment contemplates that color formulations conveniently provided by the PANTONE® System can be utilized, as for example, by storage in a look up table, to produce thousands of desirable output colors and shades in a customer selectable color printing. Using this system, as few as two different color liquid developing materials, from supply containers 111A and 111B for example, can be combined in reservoir 150 to expand the color gamut of customer selectable colors far beyond the colors available via half tone imaging techniques. An essential component of the liquid developing material color mixing and control system of the present invention is a color control system. That is, since different components of the blended liquid developing material in reservoir 150 may develop at different rates, a customer selectable color mixing controller 142 is provided in order to determine appropriate amounts of each color liquid developing material in supply containers 111A, 111B . . . or 111Z to be added to supply reservoir 150, and to controllably supply each of such appropriate amounts of liquid developing material.

Controller 142 may take the form of any known microprocessor based memory and processing device, as are well known in the art. The approach provided by the color mixing control system of the present invention includes a sensing device 140, for example, an optical sensor for monitoring the output color of the toner layer on donor roll. Sensor 140 is connected to controller 142 for providing sensed color information thereto, which, in turn is used for controlling the flow of the variously colored replenishing liquid developing materials from dispensers 111A–111Z, carrier fluid dispenser 115, and a charge control additive, sometimes referred to as a charge director, dispenser 117. The colored developing materials in dispensers 111A–111Z correspond to the basic constituent colors of a color matching system, and are selectively delivered into the liquid developing material supply reservoir 150 from each of the supply containers 111A–111Z to produce the customer selectable color output image.

Figure 3:
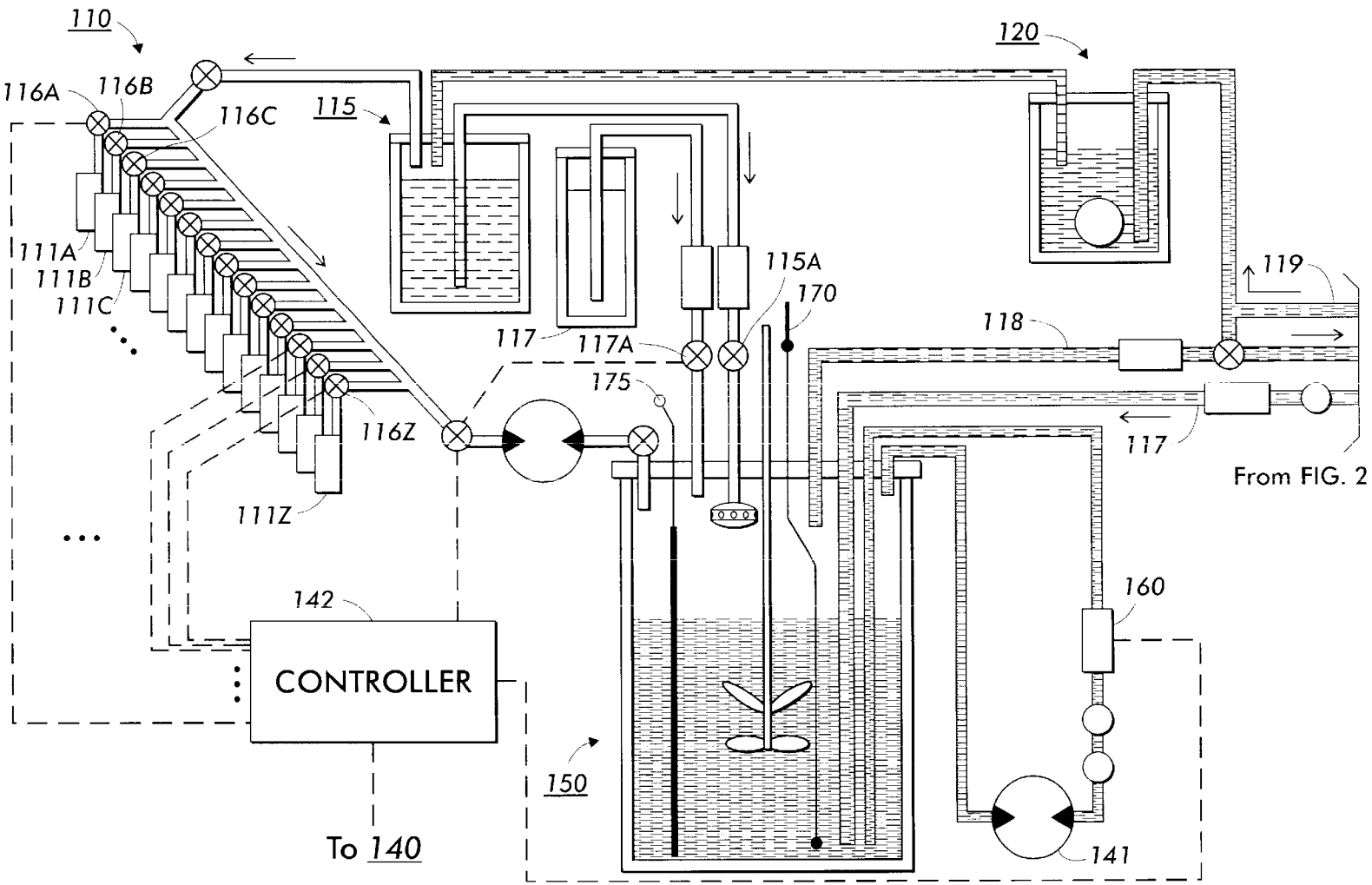

In a preferred embodiment, as shown in the FIG. 3, employs a Smart Ink Management System (SIMS) controller 142 is coupled to control valves 116A–116Z, 115A and 117A for selective actuation thereof to control the flow of liquid developing material from each supply container 111A–111Z, 115 and 117. It will be understood that these valves may be replaced by pump devices or any other suitable flow control mechanisms as known in the art, so as to be substituted thereby. In the preferred embodiment of the present invention, color accuracy is maintained by monitoring and sensing the color toner layer on donor roll 200 and or of the developer material in the container 150, in a manner similar to the process disclosed in U.S. Pat. No. 6,052,195. Alternatively, an area identified in an image as corresponding to the customer selectable color may be monitored and sensed in a manner similar to the process disclosed in U.S. Pat. No. 5,450,165, incorporated by reference herein, so as to obviate the need for the printing of a test image. Monitoring of the color output image for color accuracy can be facilitated by sensor 140 such as a calorimeter of the type known in the art utilizing any technique for measuring color and sensor 141 such as a spectrophotometer is used to provide the real time measurement of the transmission or reflection spectrum of liquid developer as prints are made. Additional sensors include thermometer 170, to monitor the temperature of the developer material in container 150, height sensor 175, which measures the volume of the developer material in container 150 by measuring the height and the dimensions of the container, and conductimeter 160, which measures the conductivity of the developer material. All of these sensor and the color sensor described below provide feedback signals to the controller 142.

Sensors 140 and 141, senses the actual color, and in turn, provides an image feedback signal to controller 142, the signal being processed by conventional electronic circuitry in order to selectively control the operation of valves 116A–116Z, 115A and 117A. In order to maintain precise color control, each selected developing material concentrate is preferably dispensed in a relatively small amount into the reservoir 150 where it is thoroughly mixed with the developing material therein to produce the desired customer selectable color developing material. While sensor 140 can take various forms and could be of many types as are well known in the art.

The color is typically defined in terms of a particular color coordinate system, such as, for example, the well recognized standardized color notation system for defining uniform color spaces developed by the Commission Internationale de I'Eclairage (CIE). The CIE color specification system employs so called "tristimulus values" to specify colors and to establish device independent color spaces. The CIE standards are widely accepted because measured colors can be readily expressed in the CIE recommended coordinate systems through the use of relatively straight-forward mathematical transformations. Once the color for a monitored test image is determined, the color of the measured sample is compared to the known values corresponding to the desired output color (as may be provided by the color matching system) to determine the precise color formulation necessary making up the supply of operative developing material in reservoir 150 to yield a correct color match on the output image. This information is processed by controller 142 for selectively actuating valves 116–116Z and 115A to systematically dispense to the reservoir 150 selective amounts of liquid developing material concentrate corresponding to selected basic color components from selected supply dispensers 111A–111Z and liquid carrier dispenser 115.

In an exemplary embodiment for implementing the present invention, the required concentration levels of each basic color component required to generate any given color may be stored in a look up table in processor 142. The measured color of a test image is transformed into its tristimulus values and compared to the tristimulus values of the desired output color or target color. The differential result of this comparison is then transformed to provide the precise amounts of each basic color component necessary to modify the operative supply of developing material to yield the desired output color or target color.

Preferably the mixture of toner particles and liquid carrier in supply dispensers 111A–111Z is between 8–25 percent by weight, although this amount may vary from this range provided that the objectives of the present invention are achieved.

In the reservoir 150 more liquid carrier is added; the liquid carrier medium is present in a large amount in the developer composition, and constitutes that percentage by weight of the developer not accounted for by the other components. The liquid medium is usually present in an amount of from about 80 to about 98 percent by weight, although this amount may vary from this range provided that the objectives of the present invention are achieved. By way of example, the liquid carrier medium may be selected from a wide variety of materials, including, but not limited to, any of several hydrocarbon liquids conventionally employed for liquid development processes, including hydrocarbons, such as high purity alkanes having from about 6 to about 14 carbon atoms, such as NORPAR® 12, NORPAR® 13, and NORPAR® 15, and including isoparaffinic hydrocarbons such as ISOPAR® G, H, L, and M, available from Exxon Corporation. Other examples of materials suitable for use as a liquid carrier include AMSCO® 460 Solvent, AMSCO® OMS, available from American Mineral Spirits Company, SOLTROL®, available from Phillips Petroleum Company, PAGASOL®, available from Mobil Oil Corporation, SHELLSOL®, available from Shell Oil Company, and the like. Isoparaffinic hydrocarbons provide a preferred liquid media, since they are colorless, environmentally safe, and possess a sufficiently high vapor pressure so that a thin film of the liquid evaporates from the contacting surface within seconds at ambient temperatures. This evaporation process is highly accelerated by using heat and convection air.

The toner particles can be any pigmented particle compatible with the liquid carrier medium, such as those contained in the developers disclosed in, for example, U.S. Pat. Nos. 3,729,419; 3,841,893; 3,968,044; 4,476,210; 4,707,429; 4,762,764; 4,794,651; and 5,451,483, the disclosures of each of which are totally incorporated herein by reference. The toner particles should have an average particle diameter from about 0.2 to about 10 microns, and preferably from about 3 to about 7 microns. The toner particles may be present in amounts of from about 1 to about 10 percent by weight, and preferably from about 1 to about 4 percent by weight of the developer composition. The toner particles can consist solely of pigment particles, or may comprise a resin and a pigment; a resin and a dye; or a resin, a pigment, and a dye. Suitable resins include poly(ethyl acrylate-co-vinyl pyrrolidone), poly(N-vinyl-2-pyrrolidone), and the like. Suitable dyes include Orasol Blue 2GLN, Red G, Yellow 2GLN, Blue GN, Blue BLN, Black CN, Brown CR, all available from Ciba-Geigy, Inc., Mississauga, Ontario, Morfast Blue 100, Red 101, Red 104, Yellow 102, Black 101, Black 108, all available from Morton Chemical Company, Ajax, Ontario, Bismark Brown R (Aldrich), Neolan Blue (Ciba-Geigy), Savinyl Yellow RLS, Black RLS, Red 3GLS, Pink GBLS, and the like, all available from Sandoz Company, Mississauga, Ontario, among other manufacturers. Dyes generally are present in an amount of from about 5 to about 30 percent by weight of the toner particle, although other amounts may be present provided that the objectives of the present invention are achieved. Suitable pigment materials include carbon blacks such as MICROLITH® CT, available from BASF, PRINTEX® 140 V, available from Degussa, RAVEN® 5250 and RAVEN® 5720, available from Columbian Chemicals Company. Pigment materials may be colored, and may include magenta pigments such as Hostaperm Pink E (American Hoechst Corporation) and Lithol Scarlet (BASF), yellow pigments such as Diarylide Yellow (Dominion Color Company), cyan pigments such as Sudan Blue OS (BASF), and the like. Generally, any pigment material is suitable provided that it consists of small particles and that combine well with any polymeric material also included in the developer composition. Pigment particles are generally present in amounts of from about 5 to about 40 percent by weight of the toner particles, and preferably from about 10 to about 30 percent by weight.

In addition to the liquid carrier vehicle and toner particles which typically make up the liquid developer materials suitable for the present invention, a charge control additive sometimes referred to as a charge director may also be included for facilitating and maintaining charge on toner particles by imparting an electrical charge of selected polarity (positive or negative) to the toner particles. Examples of suitable charge control agents include lecithin, available from Fisher Inc.; OLOA 1200, a polyisobutylene succinimide, available from Chevron Chemical Company; basic barium petronate, available from Witco Inc.; zirconium octoate, available from Nuodex; as well as various forms of aluminum stearate; salts of calcium, manganese, magnesium and zinc; heptanoic acid; salts of barium, aluminum, cobalt, manganese, zinc, cerium, and zirconium octoates and the like. The charge control additive may be present in an amount of from about 0.01 to about 3 percent by weight, and preferably from about 0.02 to about 0.05 percent by weight of the developer composition.

The system of FIG. 3 has means to changeover custom colors. For example, a print job having a particular orange color which consists of a mix of two primary colors like yellow and red may be followed for another job with a different custom color like green which consists of two primary colors like yellow and blue. Therefore, reservoir 150 can be automatically flushed and cleaning between printing jobs, as necessary, by the addition of liquid carrier and pumping in the diluted developer material through the development system of FIG. 2 and out of the supply reservoir 150. This process is monitored by sensor 141 which provides feedback signal to controller 142 to assess the cleanliness of the system.

In recapitulation, there has been provided a development system that extends the functionality of SIMS and combines it with a powder development engine to enable custom color printing. This invention provides a apparatus and method, control scheme, hardware, and software, necessary for enabling custom color printing using an electrophotograpic hybrid technology. This invention combines dry powder marking engines and development technologies with toner mixing capabilities and management of liquid ink technologies. The invention proposes a Liquid SIMS—Powder Development marking engine that consists of a SIMS unit integrated with a powder marking engine.

The function of this SIMS is to supply a layer of mix dry toner with the appropriate custom color L*a*b* values to the development subsystem 410 to enable the printing of the customer selected custom color, i.e., the function of the donor roll. Another function is to reclaim the undeveloped toner mixture and return it to the supply sump. This invention provides a method to deliver custom color toner to the development subsystem and to develop this mixture using known, proved powder development technologies, means to reclaim the undeveloped toner, sensors and controls to maintain the toner supply sump stable. This SIMS consists of a multiplicity of component toner supply containers, powder dispensers, dispersion units, a mixing ink supply sump, pumps and valves to introduce controlled amounts of basic colorants, sensors and controls to assure the accuracy of the sump color, ink applicator to apply the mixture to a drum or belt, ink conditioning devices to concentrate and finally dry the ink film to a powder toner layer, reclaiming units for hydrocarbon fluid and managing waste, toner reclaiming devices for the undeveloped toner, toner redispersion devices for reusing and return this reclaimed ink to the sump. The entire SIMS module can be a sealed device, which will allow the use of low molecular weight—high vapor pressure hydrocarbons, e.g., Isopar G. This will enable high drying speeds and low energy consumption.

In one embodiment of this invention, the development process consists of ion charging the toner layer, deliver this charged toner mixture to the development nip to encounter the photoreceptor, and develop the image by AC jumping. In another embodiment the development process consists of charging the toner layer using an ionographic head, and subsequently transferring the toner image to a belt.

This invention provides the following custom color processes of color blending in machine, dispersion of powder toner or high concentration dispersions of toners on Isopar type fluids to produce inks, and mixing and controlling the color of these inks using SIMS, and color changeover in machine, fully automatic, ~minutes change over time. It is therefore apparent that there has been provided in accordance with the present invention, that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A method for creating a color image representing a document in a printing machine including a charge retentive surface, a first imaging device and a second imaging device, and a first developer unit and a second developer unit comprising:

recording a latent image on the charge retentive surface moving along an endless path, with the first imaging device;

developing said latent image with the first developer unit having developer material comprising dry marking particles of a first color;

recording a second latent image on said charge retentive surface moving along said endless path, with the second imaging device;

developing said second latent image with the second developer unit having developer material comprising a solution liquid carrier and marking particles of a second color.

2. The method of claim 1, wherein said second developing step includes applying a layer of the liquid marking particles of the second color to a donor member;

conditioning the layer of the liquid marking particle to remove the liquid carrier from the marking particles to form a layer of the marking particles.

3. The method of claim 2, further including the steps of:

ion charging the layer of the marking particles; and generating a cloud from the layer of the marking particles to develop to develop the latent image.

4. The method of claim 1, further comprising mixing marking particles of a third color with marking particles of a fourth color to form the marking particles of the second color.

5. The method of claim 4, further comprising color matching the marking particles of the second color to a desired color target.

* * * * *